US008178265B2

(12) United States Patent
Black et al.

(10) Patent No.: US 8,178,265 B2
(45) Date of Patent: May 15, 2012

(54) ELECTROPHOTOGRAPHIC PHOTORECEPTOR HAVING A SPECTRAL MARKER AND ELECTROPHOTOGRAPHIC PRINTER USING THE SAME

(75) Inventors: David Glenn Black, Longmont, CO (US); James Alan Hartman, Broomfield, CO (US); Rudolph Wayne Hrobsky, Longmont, CO (US); Ronald Harold Levin, Lafayette, CO (US); Robert Max Lopez, Jr., Loveland, CO (US); Weimei Luo, Louisville, CO (US); Dat Quoc Nguyen, Platteville, CO (US); Franklin Dilworth Zartman, Loveland, CO (US)

(73) Assignee: Lexmark International, Inc., Lexington, KY (US)

( * ) Notice: Subject to any disclaimer, the term of this patent is extended or adjusted under 35 U.S.C. 154(b) by 510 days.

(21) Appl. No.: 12/344,750

(22) Filed: Dec. 29, 2008

(65) Prior Publication Data

US 2010/0167191 A1 Jul. 1, 2010

(51) Int. Cl.
*G03G 15/02* (2006.01)

(52) U.S. Cl. ..... 430/58.05; 430/57.1

(58) Field of Classification Search ..... 430/57.1, 430/58.05

See application file for complete search history.

(56) References Cited

U.S. PATENT DOCUMENTS

| | | | | |
|---|---|---|---|---|
| 6,268,095 | B1 * | 7/2001 | Kuroda | 430/58.35 |
| 2008/0138727 | A1 * | 6/2008 | Fukushima et al. | 430/58.35 |
| 2008/0166642 | A1 * | 7/2008 | Obata et al. | 430/58.7 |

* cited by examiner

*Primary Examiner* — Hoa V Le

(57) ABSTRACT

A photoreceptor comprising a spectral marker and an electrophotographic printer using the same wherein the presence of the spectral marker is detected by the spectral marker detector, which enables photoreceptor authentication and thickness determinations, thereby permitting adjustment and optimization of component operating parameters within the electrophotographic printer.

11 Claims, 12 Drawing Sheets

ELECTROPHOTOGRAPHIC PHOTORECEPTOR HAVING A SPECTRAL MARKER AND ELECTROPHOTOGRAPHIC PRINTER USING THE SAME

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to an electrophotographic (EP) photoreceptor within an EP printer. More particularly, the invention relates to authenticating and determining the thickness of an electrophotographic photoreceptor incorporating a spectral marker.

2. Description of the Related Art

An EP printer, such as a laser printer, is comprised of a print engine and a replaceable EP process cartridge. The replaceable process cartridge supplies toner, as well other wearing components necessary for the electrophotographic process. The photoreceptor is generally thought of as a replaceable supply, but may be found within either the print engine, or the process cartridge.

The useful life of an EP supply cartridge typically runs from a few thousand, to several tens-of-thousands of prints, while a print engine may have a rated life in the hundreds-of-thousands of prints. Printer original equipment manufacturers (OEMs) develop print engines and process cartridges in tandem, since they must work together to maintain image quality throughout the life of both of these printer components. Printer development typically includes: (1) optimization of out-of-box properties for the print engine and process cartridge; (2) a comprehensive study of how image quality changes throughout the life of the print engine and process cartridge.

FIG. 1 shows the voltage vs. exposure energy curves for photoreceptors 10 and 12, as measured on an in-house electrostatic tester described herein. The electrostatic tester generates a plot of photoreceptor voltage as a function of laser exposure energy. The resulting curve is called a photoinduced discharge (PID) curve. The PID curves show the level of electrical contrast between exposed and unexposed regions of the photoreceptor. Lower exposure energies are therefore used when printing lower optical densities, such as halftone images. Higher exposure energies are used when printing darker densities, such as all black images. The initial electrostatics between photoreceptors 10 and 12 are similar at low exposure energies, but separate at higher energies. The properties of EP components, such as the EP photoreceptor, must also be studied over the life of the print engine and process cartridge. FIG. 2 plots the photoreceptor voltage over 50,000 (50 k) prints for photoreceptors 20 and 22 as measured in a printer. The lines show how the electrostatics from an all black page, using the factory preset print mode, change with printing. The zigzagging lines trace the photoreceptor electrostatics at the beginning (cold) and end (hot) of a series of five 10,000 (10 k) print runs. The sloped lines represent the hot-cold fatigue arising from electrostatic measurements taken at the end, and beginning of a 10 k print run. Photoreceptor 20 undergoes negative fatigue, both hot-to-cold, and fatigue over the 50 k prints. Negative fatigue describes a photoreceptor that shows a lower degree of discharge at a given exposure energy, with usage. Conversely, positive fatigue describes a higher degree of discharge at a given exposure energy, with usage. Photoreceptor 22 shows positive fatigue, both hot-cold, and fatigue over the 50 k prints usage. FIG. 3 plots the electrostatics for photoreceptor drums 30 and 32 printed at an all black optical density, using a toner saving run mode. The optical densities are generally lower than the standard preset mode. Photoreceptor 30 shows negative fatigue, both hot-cold, and fatigue over 50 k prints. Photoreceptor 32 shows more stable electrostatics, both hot-cold, and over 0-50 k prints.

Once component fatigue patterns are modeled, optical density (OD) compensation schemes may be developed to offset OD changes as a function of usage. These methods typically involve either predictive algorithms, or toner patch sensing. Printer usage is measured and stored in a number of different ways, including: page counting, pel counting, toner paddle torque sensing, and EP component cycle counting. Predictive algorithms employ usage measurements to change one or more EP operating points to maintain substantially constant image properties. Toner patch sensing operates by creating a toner patch on the photoreceptor with a set of predetermined EP operating points to give a theoretical patch OD. A light source, such as an LED, irradiates the surface of the photoreceptor with a beam of light. The light source is typically an IR emitter, since carbon black, a component of black toner, absorbs strongly in this range. A sensor or detector, such as a photodiode, measures the intensity of the reflected light. Reflectance data is then related to the OD of the patch. The measured OD of the patch is compared to the predicted value stored in the printer. EP operating points are changed to reflect whether the patch was lighter or darker than the predicted value. The print optimization work that enables these compensation schemes is done using process cartridges designed for specific print engine families. If one or more electrophotographic components are substituted for, such as the EP photoreceptor, the utility of these methods become compromised and may result in poorer quality images.

Toner patch sensing attempts to compensate for light or dark print by changing EP operating points. FIG. 4 shows the PID curves for photoreceptors 40 and 42. Assume that the print engine/process cartridge optimizations were designed around photoreceptor 40, but the current process cartridge contains photoreceptor 42. This situation may arise when using an aftermarket photoreceptor that has not been optimized for use within this printer. Print density as a function of exposure energy will be significantly lower for photoreceptor 42 than the toner patch system predicted. The compensation scheme will attempt to increase the OD of the print by, for example, increasing the laser power and/or laser pulse width. Changing EP operating points in the extreme could decrease print speed, diminish image quality, generate excess heat, and decrease component life. In other words, the electrical properties of the process cartridge can adversely affect the life of components within the print engine. A higher rate of component degradation may not become apparent for quite some time. A lower print engine life may not, therefore, be correlated to the process cartridge by the user. Since EP photoreceptors and EP printers are developed in tandem by the OEM, a means for recognizing the OEM photoreceptor within a printer family would be of great use. For example, authentication of an OEM photoreceptor by that OEM's printer could be a prerequisite for employing OD compensation schemes.

Additionally, information stored within the EP printer would be useful to the OEM when trouble-shooting print engine failures.

Systems designed to maintain image quality do not typically measure physical properties of EP components directly. Predictive algorithms do not require real-time input, and toner patch sensing measures the amount of developed toner on an imaging surface. Knowledge of the EP component properties, such as the thickness of the photosensitive layer, would be useful. For example, the end of cartridge life in some EP printers is determined when a narrow black band is observed at the left edge of the paper. This band occurs at photoreceptor frequency and is caused by high photoreceptor wear, often at the drive side of the printer. When a portion of the photoreceptor coating becomes too thin to hold charge, this region develops toner that is transferred to paper. FIG. 5 shows an example of this cartridge end-of-life mechanism where toner 500 has been transferred to the paper 501. Thickness data in high wear areas could be used to warn the user when the photosensitive layer thickness was becoming too thin to hold charge. Determining the photoreceptor layer thickness within a printer would also be of interest as an input for print density compensation schemes. FIG. 6 shows the PID curves for three photoreceptors 60, 62, and 64 which differ only by the thickness of the charge transport layer. The differences arise from a complex interaction of capacitance, which is inversely related to thickness, and charge transit time, which is proportional to thickness. Capacitance dominates the lower exposure energy region, while charge transit time dominates the high energy region. Capacitance also affects transfer of toner from the photoreceptor to a receiving substrate, such as paper.

Information regarding the photoreceptor may be stored in either the print engine or process cartridge. Data storage methods within EP print engines and process cartridges are well known in the EP arts. For example, data may be stored in the computer of the print engine, or in a memory element within the process cartridge. The same elements which control EP operating points may also use photoreceptor authentication and thickness determinations as inputs. Modern EP printers typically contain data transfer circuits, and system cards comprising: microprocessors, digital signal processors, controllers, as well as other stored program processors. These elements may also be used for calculations and conversions.

In a general sense, the photoreceptor is called upon to create (with the image writing light source), develop, and transfer a latent image to a substrate. The physical properties of the photoreceptor are critical for the performance of these tasks. As such, determining properties of the photoreceptor, such as the photosensitive layer thickness, is important to characterize the current state of print quality in an electrophotographic printer. A method for measuring the photosensitive layer thickness in an EP printer represents an unmet need within the electrophotographic arts.

To summarize, the present invention addresses at least two unmet needs associated with EP printers: (1) OEM photoreceptor authentication within an EP printer; (2) thickness determination of an OEM photoreceptor within an EP printer.

SUMMARY OF THE INVENTION

One aspect of the invention describes an EP photoreceptor comprising a spectral marker. The spectral marker is used for: (1) authenticating an OEM photoreceptor designed for use within an OEM printer family; and or (2) determining the photosensitive layer thickness of an OEM photoreceptor within an OEM printer family. Another aspect of the invention describes a spectral marker detector light source and spectral marker detector. The spectral marker detector light source irradiates or illuminates the surface of the photoreceptor with electromagnetic radiation, and the spectral marker detector measures the reflected light. The reflectance value may be used to determine if an OEM photoreceptor is currently being used. Additionally, elements within the EP printer may convert reflectance data into absorbance units. Absorbance data may, in turn, be related to photosensitive layer thickness using a formula derived from a Beers' Law calculation stored within the EP printer. This information may be acted upon by the EP printer system. These actions include, but are not limited to: (1) implementing density compensation schemes; and (2) changing EP printer operating points as a function of photoreceptor thickness.

These and additional objects and advantages provided by the embodiments of the present invention will be more fully understood in view of the following detailed description, in conjunction with the drawings.

BRIEF DESCRIPTION OF THE DRAWINGS

The following detailed description of specific embodiments of the present invention can be best understood when read in conjunction with the enclosed drawings wherein.

Figure 1:
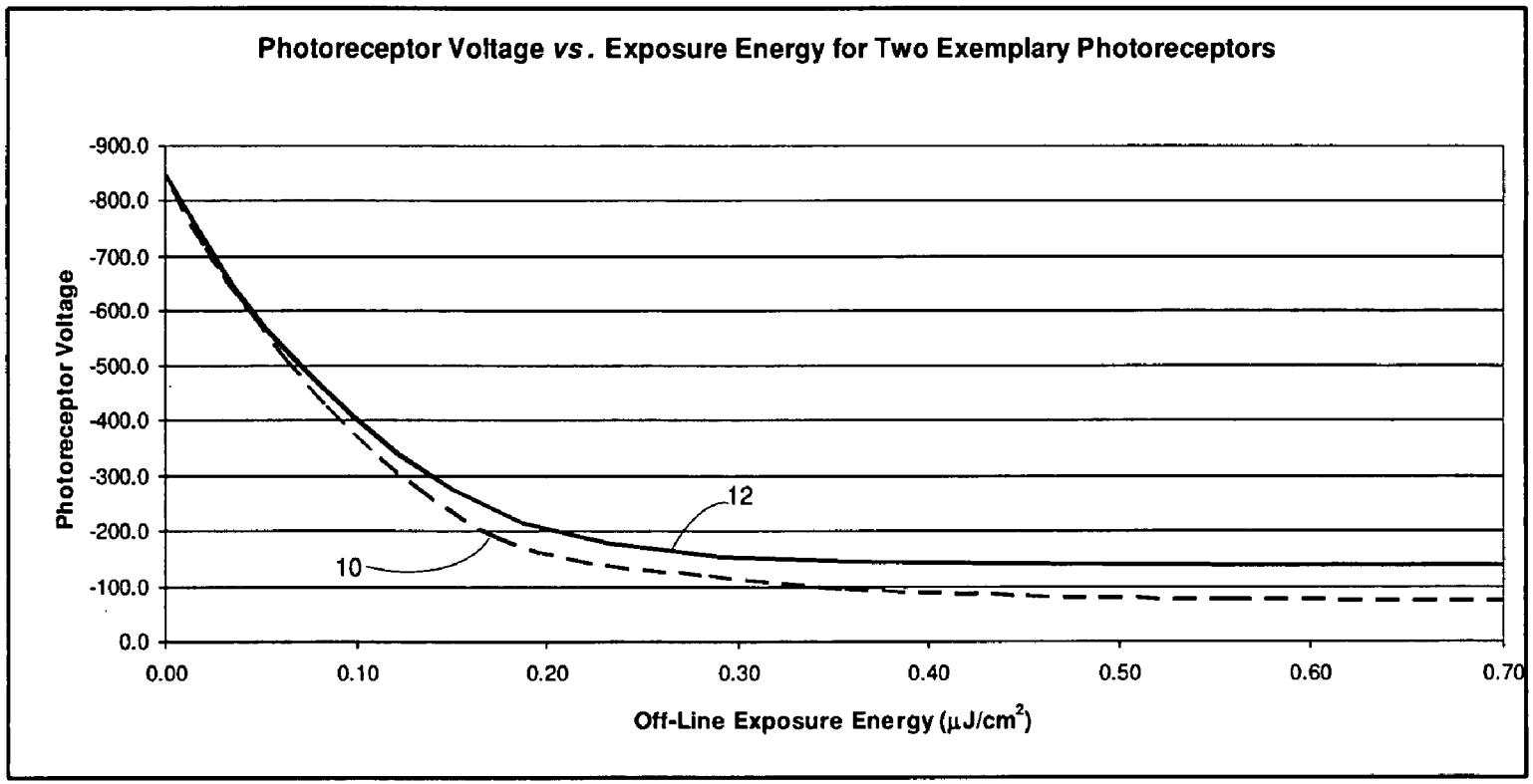
FIG. 1 is a plot of the PID curves for two exemplary photoreceptors.
Figure 2:
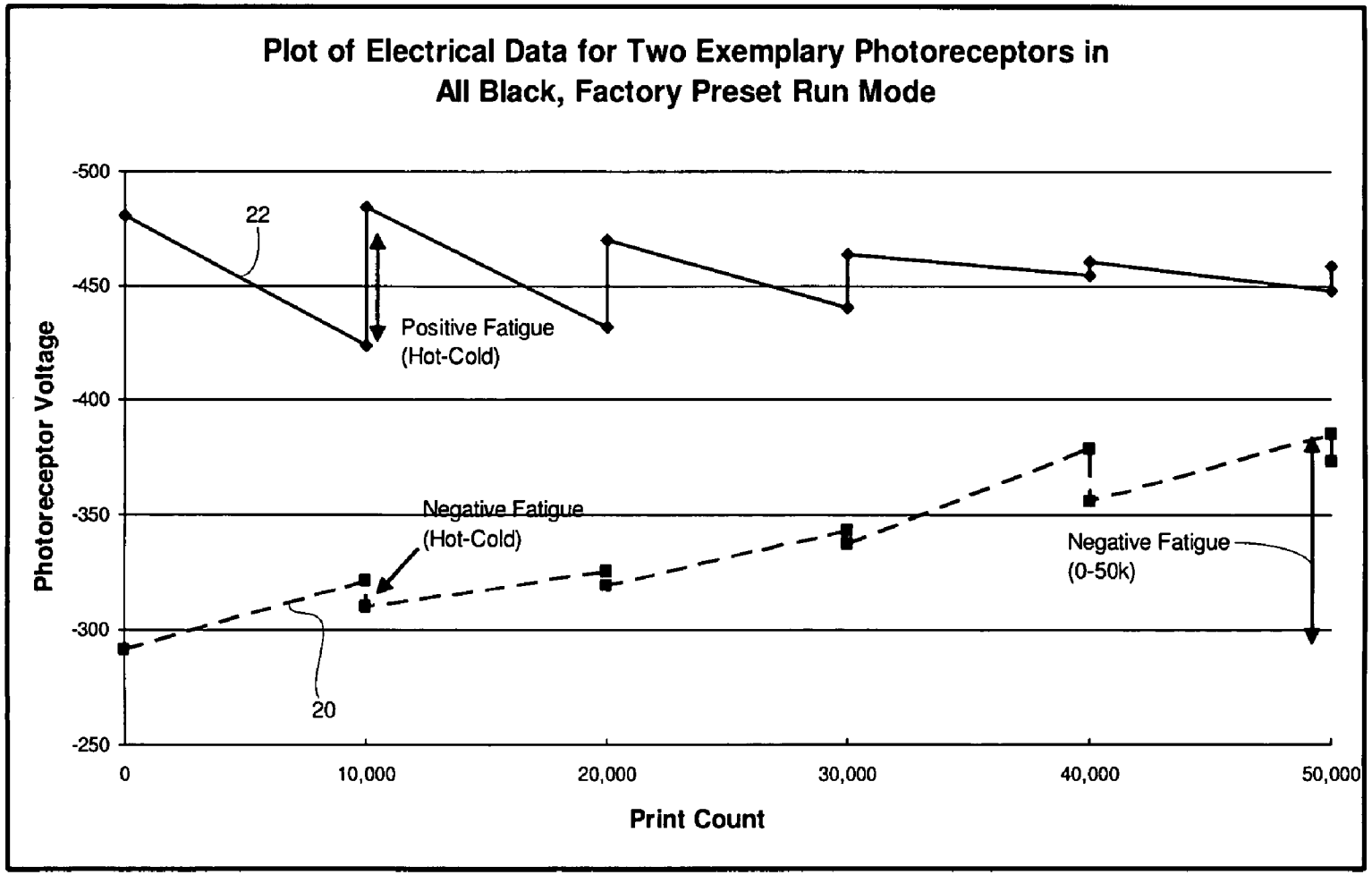
FIG. 2 is a plot of the all-black discharge voltages in the factory preset run mode for two exemplary photoreceptors recorded over 50 k prints.
Figure 3:
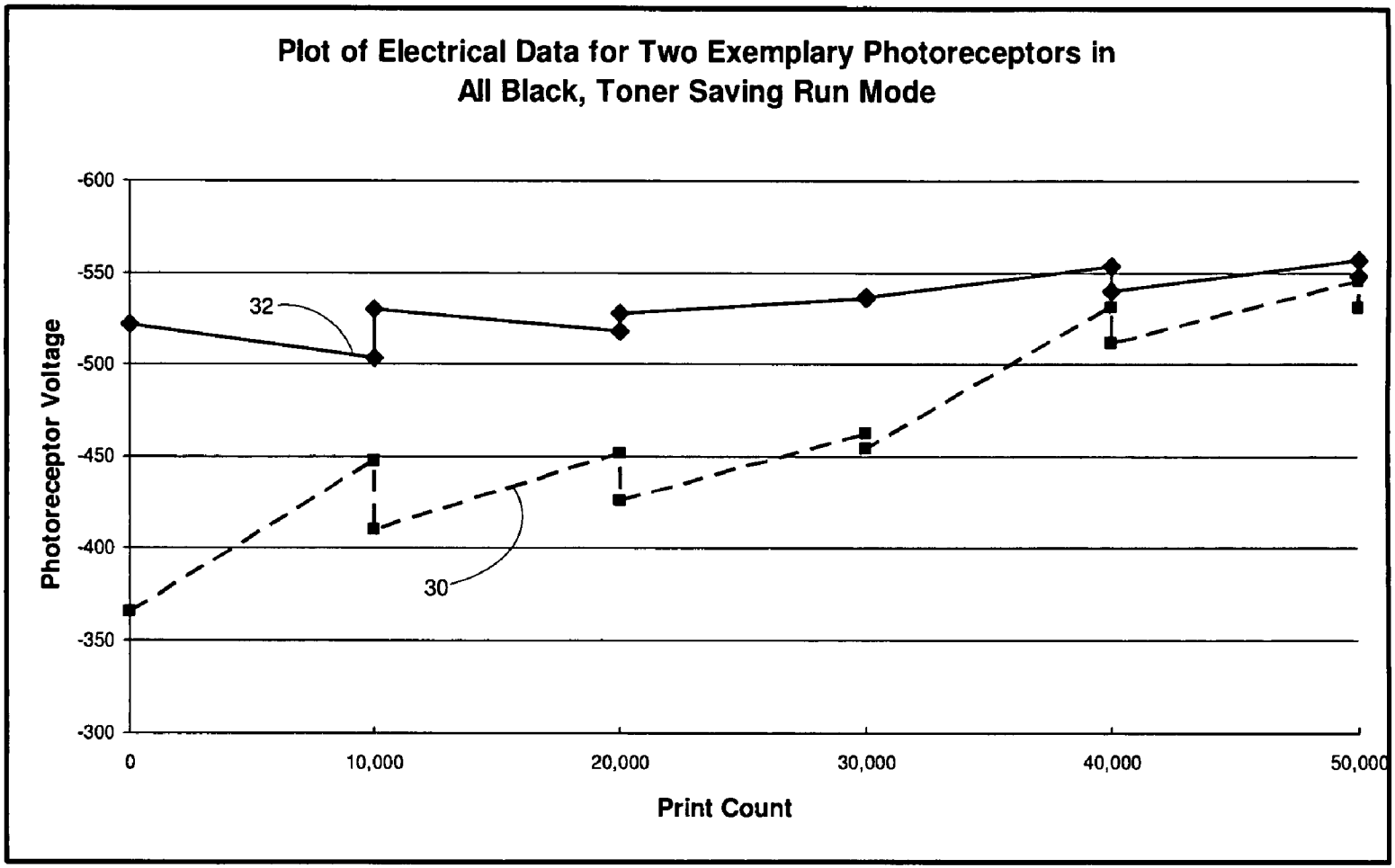
FIG. 3 is a plot of the all-black discharge voltages in a toner saving run mode for two exemplary photoreceptors recorded over 50 k prints.
Figure 4:
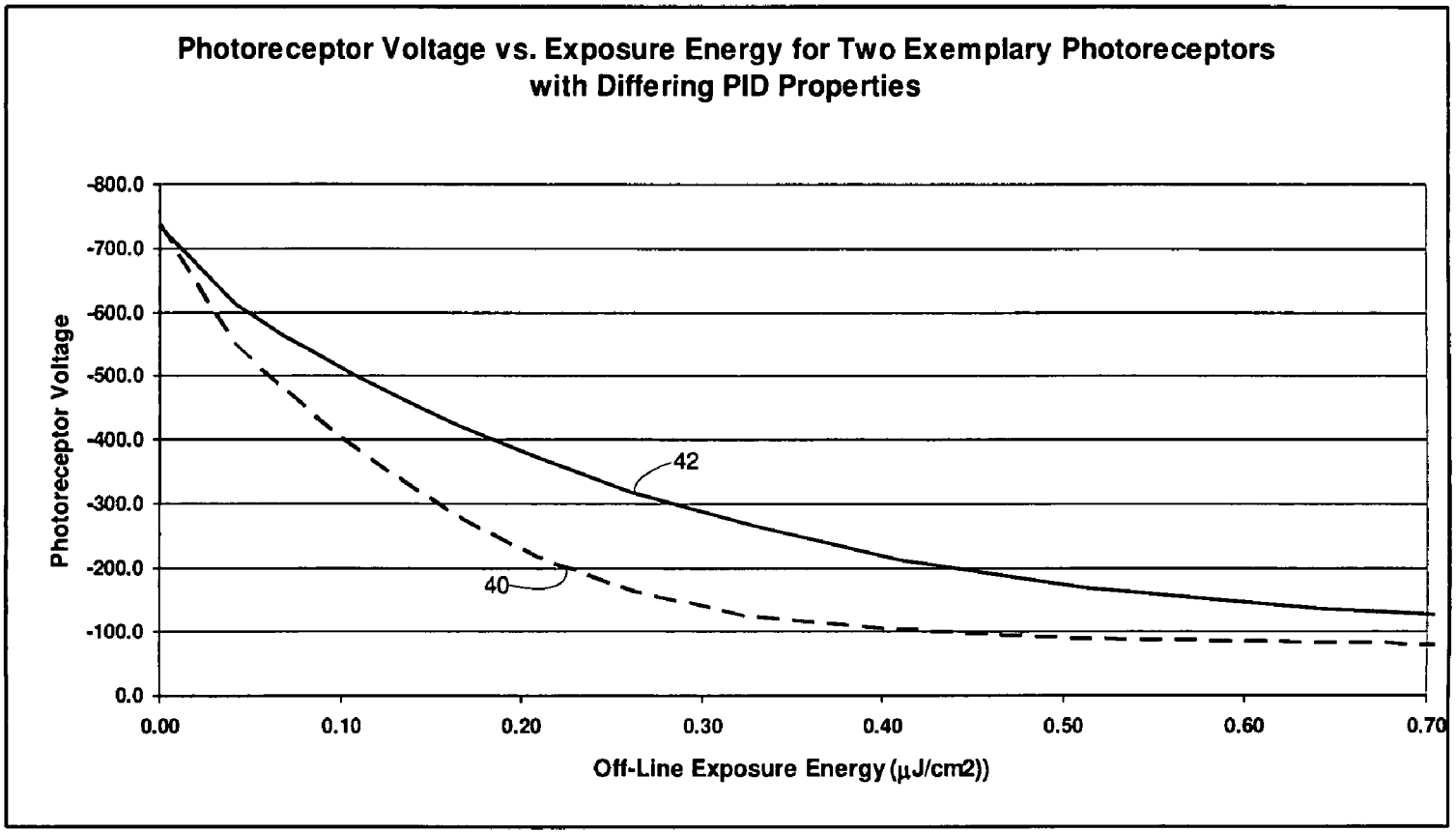
FIG. 4 is a plot of the PID curves for two exemplary photoreceptors.
Figure 5:
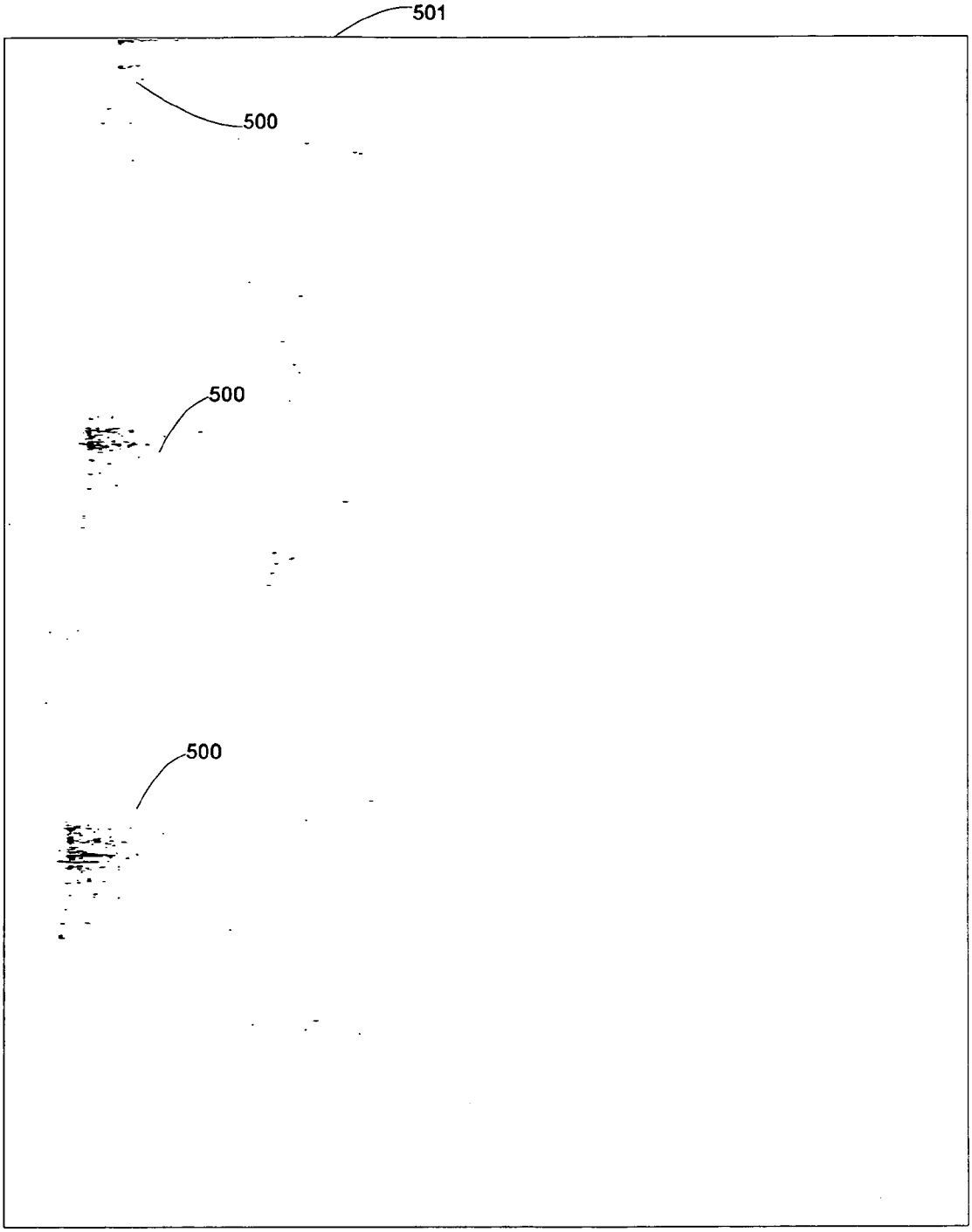
FIG. 5 is the scanned image of a print exhibiting a cartridge end of life failure mechanism.
Figure 6:
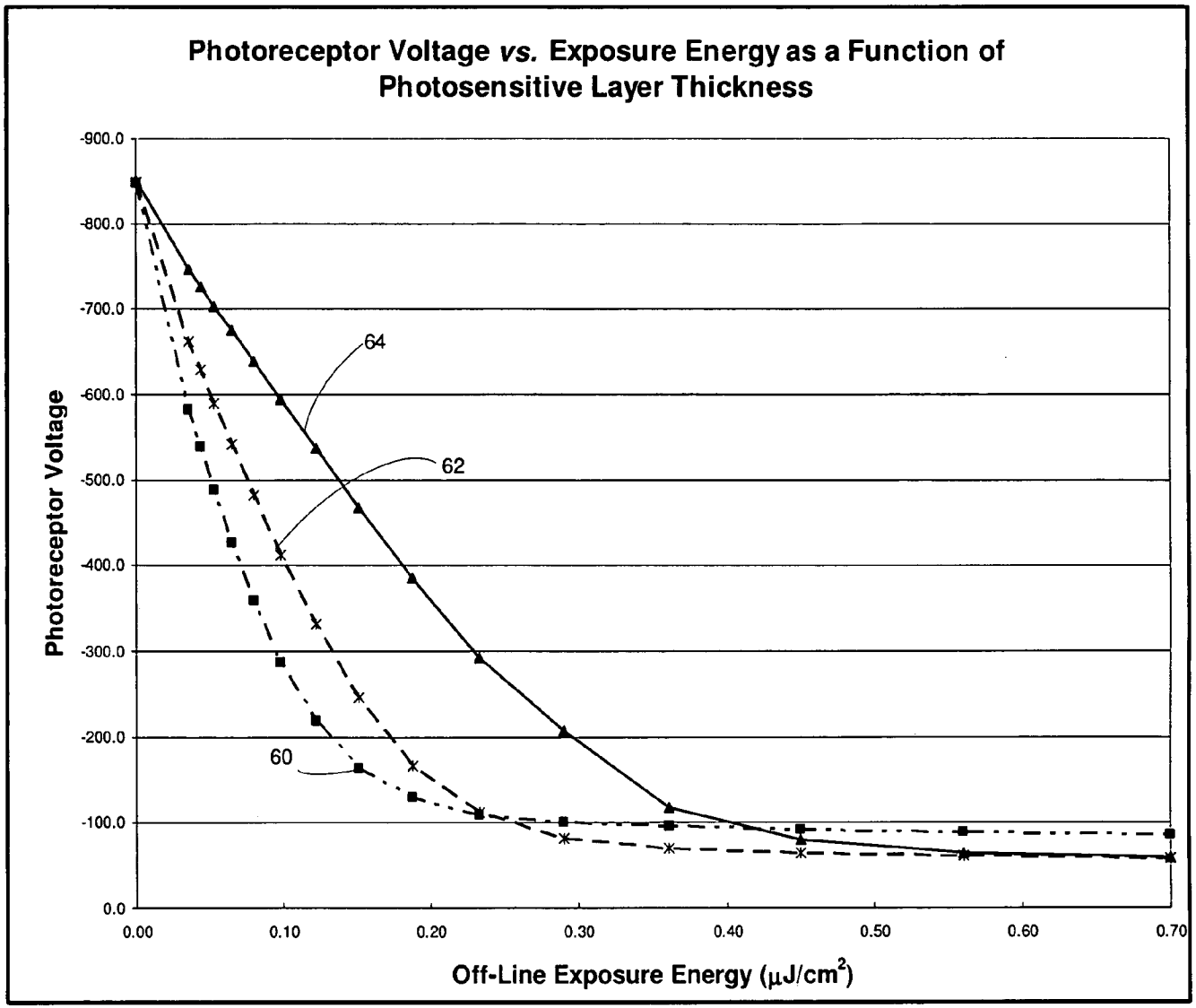
FIG. 6 is a plot of the PID curves for three exemplary photoreceptors differing only by the thickness of the photoreceptor charge transport layer.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION

Exemplary embodiments of the present invention are directed to (1) photoreceptor authentication within an electrophotographic printer, and (2) measuring the thickness of electrophotographic photoreceptors within an electrophotographic printer.

EP Printers and Photoreceptors

Electrophotographic printer components needed for current EP printers include: a photoreceptor, a charge roll, a laser diode, a developer roll, a transfer member, and a fuser. Creating an image using these components in an EP printer comprises, in general, the following steps:

(1) charging the surface of an imaging element, such as a photoreceptor;

(2) creating a latent image by dissipating the charge on the imaging element in an image-wise manner by irradiation with light;

(3) developing the latent image with a marking material, such as electrophotographic toner, to form a toned image on the imaging element;

(4) transferring the toned image to a receiving substrate, such as paper;

(5) fusing the toner to a receiving substrate; and (6) cleaning the imaging element.

Figure 7:
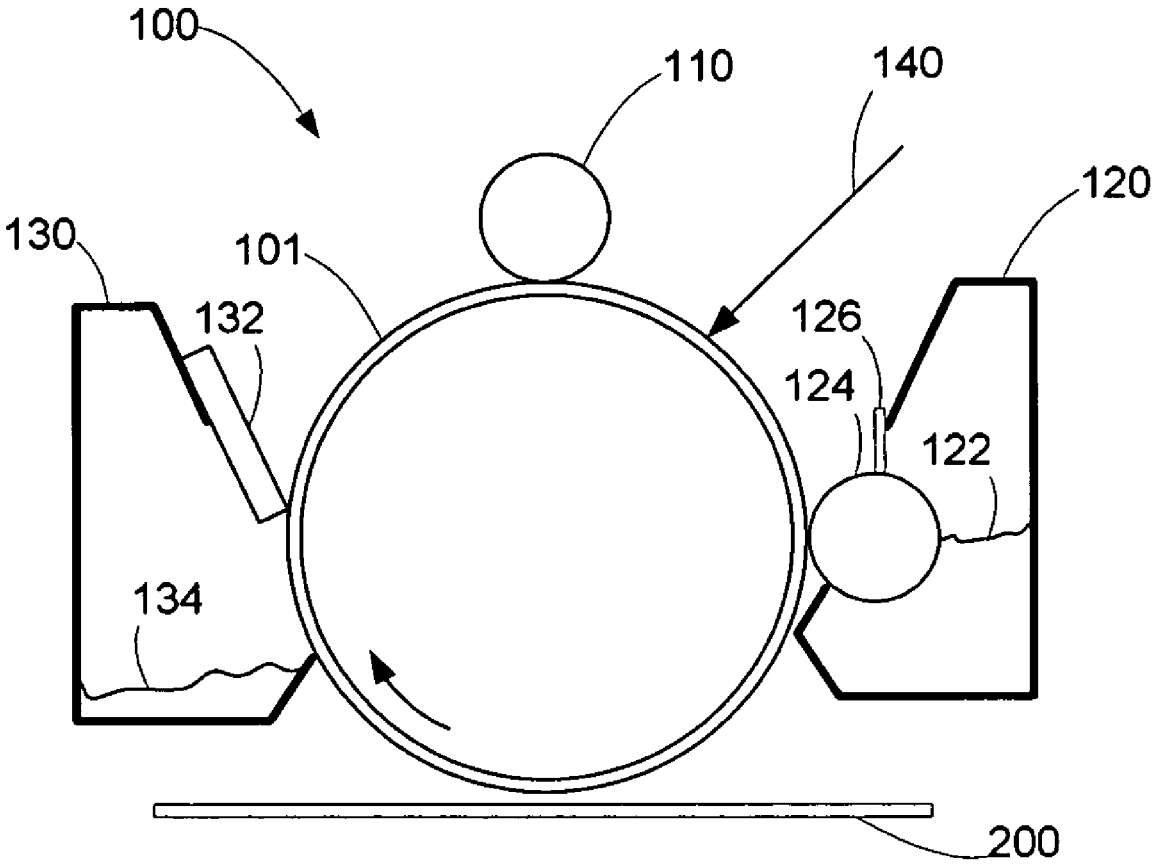
FIG. 7 is a schematic illustrating a photoreceptor in conjunction with a developing unit, cleaning unit, charging roller according to one or more embodiments of the present invention.

The photoreceptor of the present invention may be utilized in various printer configurations familiar to one of ordinary skill in the art. One such configuration is illustrated in FIG. 7. The image forming apparatus 100 (e.g., a printer) may comprise a photoreceptor 101, a charging roller 110, a developer unit 120 and a cleaner unit 130. The charging roller 110 negatively charges the surface of the photoreceptor 101. The charged surface of the photoreceptor 101 may then be irradiated by a laser light source 140 to form an electrostatic latent image on the photoreceptor 101 corresponding to an image. The developing unit 120 may include a toner sump 122, a developer roller 124 and a toner metering device 126. Toner in the sump is transferred to the surface of developer roll 124 by various means including a toner transfer roller (not shown). The toner metering device 126, such as a doctor blade, serves as a means of providing a uniform layer of toner on the surface of the developer roller 124. The developer roller 124 and doctor blade 126 can be charged which in turn charges the toner. The toner is charged so that it is attracted to the latent image on the photoreceptor 101. The toned image from the photoreceptor 101 may be transferred directly to a recording medium, (e.g., paper 200) or to an intermediate transfer member such as a transfer belt (not shown) from which the toned image is transferred to the paper 200. A fusing unit (not shown) is used to fuse the toned image to the paper 200. A cleaning unit 130 uses a cleaning blade 132 to scrape off any residual toner still adhering to the photoreceptor 101 after the toned image is transferred to the paper 200. The cleaned surface of the photoreceptor 101 can now be charged again, repeating the imaging and printing cycle. Waste toner 134 is held in a waste toner sump in the cleaning unit 130.

The photoreceptor of the present invention can be part of an EP imaging apparatus such as a printer or a multifunction machine having at least printing, scanning and copying functions, or a copier. In the embodiment shown in FIG. 8, imaging apparatus 200 is shown as an EP printer that includes a controller 204, a print engine 206, a process cartridge 210 that may include a photoreceptor of the present invention and the other elements illustrated in FIG. 7, and a user interface 220. Imaging apparatus 200 may communicate with computer 240 via bus 244 using a standard communication protocol, such as for example, universal serial bus (USB), Ethernet or IEEE 802.xx.

Controller 204 includes a processor unit and associated memory 208, and may be formed as one or more Application Specific Integrated Circuits (ASIC). Memory 208 may be, for example, random access memory (RAM), read only memory (ROM), and/or non-volatile RAM (NVRAM). Alternatively, memory 208 may be in the form of a separate electronic memory (e.g., RAM, ROM, and/or NVRAM), a hard drive, a CD or DVD drive, or any memory device convenient for use with controller 204. Various programs that may be stored in memory 208 and are used to control operation of the imaging apparatus are executed in controller 200.

Figure 8:
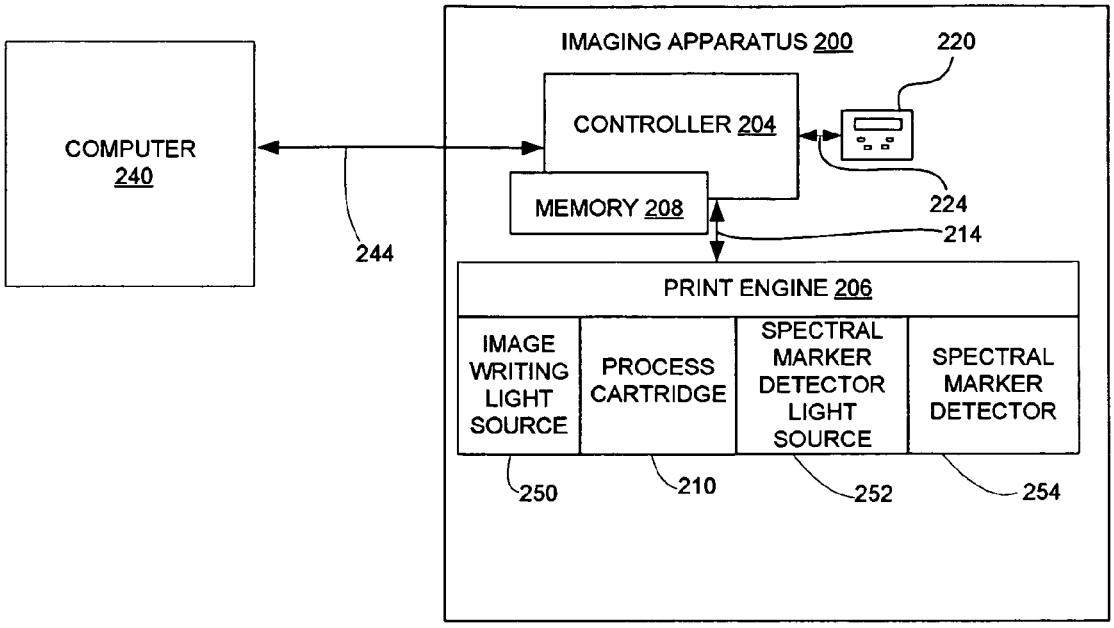
FIG. 8 is a schematic illustration of an EP printing system embodying the spectral marker detector light source and spectral marker detector of the present invention.

In the illustrated embodiment in FIG. 8, controller 204 communicates with print engine 206 via a communications link 214. User interface 220 is communicatively coupled to controller 204 via a communications link 224. Controller 204 serves to process print data and to operate print engine 206 during printing. Controller 204 also communicates with image writing light source 250, spectral marker detector light source 252, and spectral marker detector 254 via link 214 or by other means as is known in the art. Controller 204 may be used to operate spectral marker detector 254 and spectral marker detector light source 252 used to illuminate the spectral marker on the photoreceptor contained within process cartridge 210 and process data obtained from the spectral marker detector 254. Controller 204 receives a signal from spectral marker detector 254 that is representative of the reflectance from the spectral marker of the photoreceptor. A signal amplifier (not shown) may be used to boost the reflectance signal that is received by the controller 204. Based on this reflectance signal, controller 204 may vary operating parameters of the printer and its various components. For example, the thickness of the photoreceptor can be determined using this reflectance signal and a warning displayed to the user when it had become too worn to hold a charge. Also the reflectance signal may be used to authenticate the photoreceptor as many programs in the controller are designed for use with a particular photoreceptor structure. Print density compensation schemes created for use with an authentic photoreceptor may also be enabled to increase optical density of the print by, for example, increasing the laser power and/or laser pulse width. The reflectance signal may also serve as an identifier of the source of the photoreceptor allowing for authentication of the photoreceptor by the EP printer.

The photoreceptor plays a pivotal role in the electrophotographic process. Photoreceptors include a photosensitive layer coated over an electrically conductive substrate, for example an aluminum tube. The photosensitive layer comprises: (1) materials capable of forming electron-hole pairs upon absorption of light, and (2) materials capable of transporting charge.

Organic photoreceptors represent the most common type of photoreceptor currently used in the EP printer industry. Organic photoreceptors may be further classified as dual layer or single layer, although additional layers may be added to achieve certain goals, such as improved wear, or lower dark decay. Dual layer photoreceptors deposit the charge generating material, and charge transporting material as two separate layers. Most dual layer organic photoreceptors are of the negative charging type. In this configuration, the charge generation layer is deposited over the conductive substrate. The charge transport layer is deposited over the charge generation layer. The charge transporting material carries 'holes' to discharge the negatively charged surface. In this configuration, the photosensitive layer represents both the charge generation and charge transport layers, since the layers work together to generate and transport charge. The single layer photoreceptor contains the charge generation material, hole transporting material, and electron transporting material in a single layer. Single layer photoreceptors are typically charged positively.

The very thin photosensitive layer is called upon to withstand abrasive wear over many print cycles from toner, media such as paper, and other components within the print engine and process cartridge.

Toner Patch Sensing and Reflectance Spectroscopy

Toner patch sensing may be viewed more broadly as a subset of reflectance spectroscopy. Reflected light from a substrate falls into two categories, specular or diffuse. Specular reflection predominates from flat, mirrored substrates using an incident angle between about 15-75° relative to the normal of the substrate. Diffuse reflectance predominates for porous substrates with matte finishes. The measured intensity of specular or diffuse reflectance is also dependent upon the emitter/substrate/detector angle. Orienting the detector such that the reflectance angle is about equal and opposite to that of the incident angle, relative to the direction normal to the substrate, favors detection of the specular component of reflectance. The detector may be oriented to detect any combination of specular or diffuse light. A plurality of detectors and/or emitters may be included to detect diffuse, specular, or total reflectance. An incident angle of 0° will provide a measure of diffuse reflectance only, since the mirror reflection cannot be measured by a detector positioned in this way. In practice, the emitter/detector orientation must be optimized experimentally to fit the space constraints of the printer under development.

The use of specular or diffuse reflectance to determine film thickness is known. A transmissive thin film coated over a reflective substrate is irradiated with light. A detector records the reflected light. Reflectance may be calculated as a ratio of detected light to emitted light. Alternatively, a background measurement may be taken of the reflective substrate in the absence of a coating. The background may also be treated as a constant for very uniform and consistent substrates. For analyses including a background input, the absorbance is calculated using the following formula:

$$\text{Absorbance} = -\log_{10}(\text{sample reflectance}/\text{background reflectance})$$

Note that the ratio of sample reflectance to background reflectance provides a normalized sample reflectance value. The absorbance value can be inserted into Beers' law, shown below.

$$\text{Absorbance} = (A)(B)(C)$$

A=extinction coefficient of absorbing group;

B=sample thickness;

C=concentration of absorbing group

Plotting thickness as a function of absorption yields the equation for a straight line when fitted using linear regression.

Reflectance spectroscopy offers other benefits that are not currently being utilized by toner patch sensing alone. Reflectance/absorbance may be used to probe properties of the photosensitive layer of the photoreceptor. Changes in photoreceptor thickness can be tracked as a method for determining usage. The absolute value of photoreceptor thickness may be used as in input variable to change electrophotographic component operating levels. Since the method measures a property of the photoreceptor directly, it is independent of the color of the marking material used. The electrically conductive substrate beneath the photosensitive layer(s) does not change during use. Moreover, the reflective properties from one substrate to another are engineered to be the same.

Background readings with a toner patch sensor system currently provide information on the thickness of the photosensitive layer, since most organic materials have some absorbance in the infrared. However, this information is of little use since the reflectance difference between a bare substrate, a CG-coated substrate, and a full structure photoreceptor is small. In fact, the small signal deviations recorded around the substrate are taken, in part, to represent the consistency of the coating thickness. These perturbations are far too small to provide quantitative information regarding photoreceptor thickness. In other words, there is a significant signal-to-noise problem. Moreover, the calculations performed in the toner patch sensing art generate optical density from the collected reflectance data. Optical density refers to the density of toner spots in a given area, not, necessarily, the thickness of the toner layer.

Electrophotographic Photoreceptor Containing Spectroscopic Marker

Figure 9:
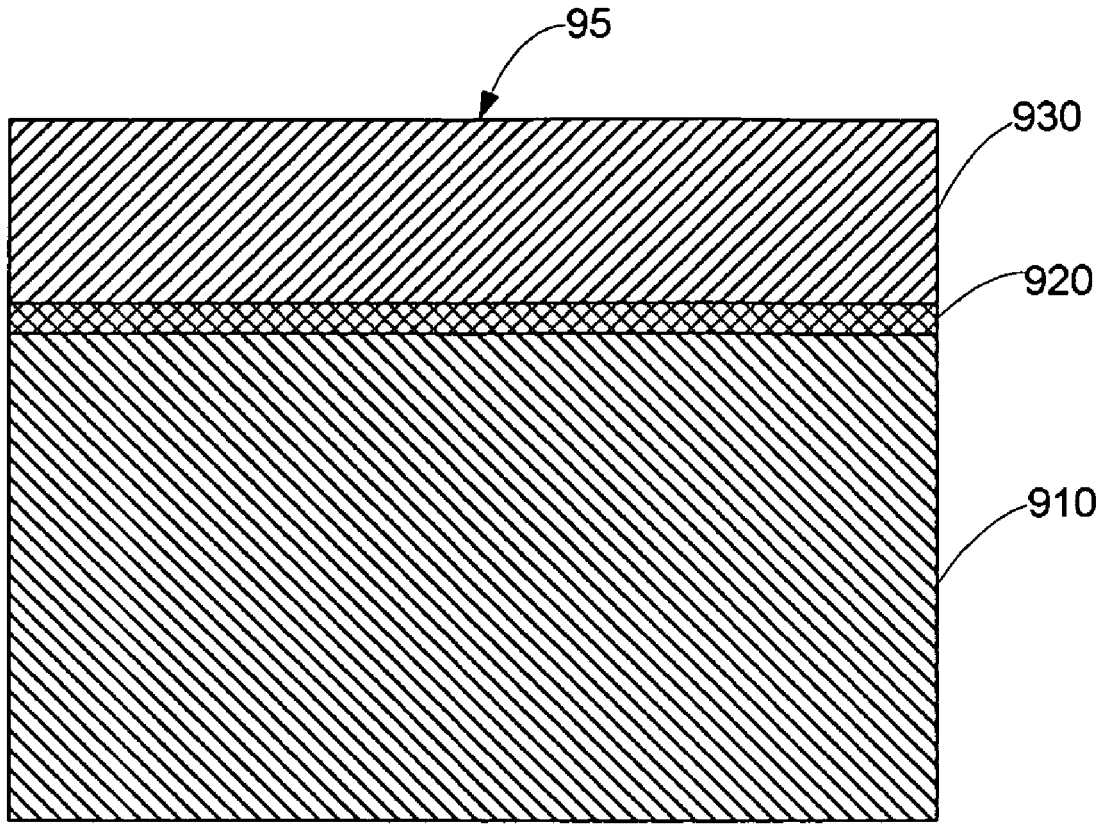
FIG. 9 is a schematic cross sectional view of a photoreceptor according to one or more embodiments of the present invention.

An electrophotographic photoreceptor must hold charge in the dark, and discharge in an image-wise manner upon exposure to light. Referring to FIG. 9, the photoreceptor 95 comprises an electrically conductive substrate 910, and a charge generation layer 920 disposed over the electrically conductive substrate 910. As used herein, "over" may mean one layer is directly on another layer, or may also allow for intervening layers, such as adhesive, and barrier layers in between. The charge generation layer 920 comprises a mixture of charge generation material(s) dispersed in a binder. Further as shown, the photoreceptor 95 comprises a charge transport layer 930 disposed over the charge generation layer 920. In this configuration, the photosensitive layer represents layers 920 and 930. For purposes of thickness determinations, thickness of charge generation layer 920 may be ignored, due to the far greater thickness of charge transport layer 930. As shown in FIG. 7, the photoreceptor 101 is in the form of a drum or tube; however, other embodiments are contemplated herein.

Referring to FIG. 9, the electrically conductive substrate 910 comprises an electrically conductive metal based material. The substrate 910 may be flexible, for example in the form of a flexible web or a belt, or inflexible, for example in the form of a drum. Typically, the photoreceptor substrate is uniformly coated with a thin layer of metal, preferably aluminum which functions as an electrical ground plane. In one embodiment, the electrically conductive substrate 910 comprises an anodized and sealed aluminum core. Alternatively, the ground plane member may comprise a metallic plate formed, for example, from aluminum or nickel, a metal drum or foil, or plastic film on which aluminum, tin oxide, indium oxide or the like is vacuum evaporated. Typically, the substrate 910 will have a thickness adequate to provide the required mechanical stability. For example, flexible web substrates generally have a thickness of from about 0.01 to about 0.1 mm, while drum substrates generally have a thickness of from about 0.75 mm to about 1.0 mm.

Photoreceptor substrates may also be anodized. This process creates a thin aluminum oxide layer on the photoreceptor surface. The resulting substrate is unstable and requires a sealing process to prevent surface changes over time. Aluminum alloy substrates that have undergone an anodizing and sealing process typically have volume resistivities of about $10^{10}$ Ω·cm or less. Core anodization is common and helps prevent interference fringes, and provides a rough substrate to improve charge generation layer adhesion. The anodization layer may be prepared to a nominal thickness of 6 μm. The anodization/sealing process creates a matte finish to the original mirrored surface of the aluminum substrate. The most suitable aluminum alloys are in the JIS 6000 series, but the 1000 series and 3000 series are also suitable. In one embodiment, the aluminum alloy substrate is JIS 6063.

The charge generation layer is coated over the conductive substrate. Conventionally, the charge generation layer comprises the charge generation compound or molecule alone and/or in combination with a binder. A charge transport layer typically comprises a polymeric binder and a charge transport compound or molecule. The charge generation compounds within the charge generation layer are sensitive to image-forming radiation and photogenerate discreet positive and negative charge units called, "electron-hole pairs," upon absorbing such radiation. The charge transport layer is usually non-absorbent of the image-forming radiation and the charge transport compounds serve to transport holes to the surface of a negatively charged photoreceptor.

Charge generation layers are generally prepared by dispersing a pigment (e.g., phthalocyanines, azo compounds, squaraines, etc.), solvent, and film forming binder in a dispersive mill. The dispersion may also contain additives to affect sensitivity, fatigue, adhesion, etc. Pigments do not typically form uniform films, nor do they adhere well to substrates. Moreover, milling pigments in solvent alone does not generally provide stable dispersions. A film forming binder, such as polyvinylbutyral, helps stabilizes dispersions, and provides excellent thin films that adhere to substrate. The binder should be mostly inert to the electrophotographic process. The relative ratio of pigment-to-binder may vary from around 10/90 to around 90/10 by weight percent. A ratio around 50/50 provides good dispersion stability and electrical properties. The percent solids relative to solvent are generally low, typically less than 10 percent by weight. Percent solids are not meant as a limiting feature of the invention, but rather, are necessary in a practical sense to prepare very thin films.

The 780 nm laser diode has come to dominate the EP printer industry. An area of active research involves use of violet and blue emitting image writing lasers. The DVD industry is driving development of these lower wavelength lasers in order to increase storage density. As the cost of violet and blue light sources decreases, the EP printing industry could use violet and blue image writing light sources to create smaller spot sizes, and thus greater image resolution. Light emission within the violet portion of the electromagnetic spectrum is between about 400 to about 430 nm; a blue emission ranges from about 431 nm to about 500 nm. Future commercial violet and blue light sources will be either lasers or LEDs and possess very narrow wavelength light emissions. The spectral ranges are therefore meant to describe the violet and blue emission regions. For example, one violet light source currently under development is a 405 nm laser. In a second non-limiting embodiment, the emission wavelength of the image writing source is about 400 to about 430 nm. In a third non-limiting embodiment, the emission wavelength of the image writing source is about 431 to about 500 nm.

Charge generation layers may be coated using any conventional technique, such as spray coating, dip coating or roll coating. This layer is typically coated to a thickness of less than 2 μm. In one embodiment, the dispersion is coated by dip-coating to a thickness less than 1 μm, in another embodiment, the layer is coated to around 0.2-0.3 μm.

The charge transport layer is deposited over the charge generation layer, and is comprised of one or more charge transport molecules and binder. Additives may also be added to improve wear, fatigue, etc. An aromatic amine such as N,N'-Bis(3-methylphenyl)-N,N'-diphenylbenzidine (TPD) is a highly effective charge transport molecule.

Other charge transport molecules, in addition to TPD, are contemplated herein. For example, and not by way of limitation, the charge transport molecules may comprises pyrazoline, fluorene derivatives, oxadiazole transport molecules such as 2,5-bis(4-diethylaminophenyl)-1,3,4-oxadiazole, imidazole, and triazole, hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone). Other suitable hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone, carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, derivatives of aminobenzaldehydes, cinnamic esters or hydroxylated benzaldehydes. Diamine and triarylamine transport molecules such as N,N-diphenyl-N,N-bis(alkylphenyl)-[1,1'-biphenyl]-4,4'-diamines wherein the alkyl is, for example, methyl, ethyl, propyl, n-butyl, or the like, or halogen substituted derivatives thereof, commonly referred to as benzidine and substituted benzidine compounds, and the like are also contemplated herein. Typical triarylamines include, for example, tritolylamine, and the like.

The polymeric binder(s) should be insulative, film forming, transmissive or partially transmissive, and provide wear resistance. Representative binder families include thermoplastics such as polycarbonates, polyesters, polyarylates, polyethers, polysulfones and the like. Molecular weights may vary widely, but are generally 20,000-100,000. Two exemplary thermoplastic binders are poly(4,4'-isopropylidene-diphenylene) carbonate (also known as polycarbonate A), and poly(4,4'-cyclohexylidene-diphenylene) carbonate (also known as polycarbonate Z)

In one embodiment, the charge transport layer may comprise an aromatic amine and a polycarbonate in an organic solvent. The organic solvent of the charge transport layer may comprise tetrahydrofuran, 1,4-dioxane, or mixtures thereof. Other solvents are contemplated herein.

Charge transport layers may be deposited using any conventional technique, such as spray coating, dip coating, roll coating, or draw-down coating. Referring again to the embodiment of FIG. 9, the charge transport layer 930 may comprise a thickness of about 20 μm to about 40 μm. In one embodiment, the charge transport layer thickness is about 25 μm. In another embodiment, the ratio of charge transport layer thickness to charge generation layer thickness ranges from about 25:1 to about 200:1.

A spectral marker is provided within the photosensitive layer of the photoreceptor. In a dual layer photoreceptor structure, the spectral marker is contained within the charge transport layer due to the thickness difference between this layer, and the thinner charge generation layer. It is believed that spectral marking may be extended to single layer photoreceptors. In this case, the spectral marker would comprise a component of the single layer coating. The spectral marker should possess the following properties: (1) significant absorbance at low percentages (high extinction coefficient at the wavelength of interest); (2) no significant absorbance at the emission wavelength of the image writing emitter; (3) solubility in charge transport layer solvent(s); (4) miscible or dispersible with components of the charge transport layer; and (5) small or insignificant impact on the electrical properties of the photoreceptor.

Imaging and infrared absorbing dyes and pigments both represent suitable candidate types for spectral marking. Dyes and pigments differ primarily on their respective solubility properties; dyes are soluble in many organic and aqueous solvent systems, while pigments are essentially insoluble. Imaging dyes and pigments are often components of inks for inkjet printers since they have large extinction coefficients throughout the visible range. Infrared dyes and pigments are used in anti-counterfeiting applications. The high extinction coefficients found in these materials allow for low percent loadings, which in turn minimize potential adverse electrostatic affects. The extinction coefficient of a molecule is a measure of how strongly a chemical species absorbs at a given wavelength, and is therefore a physical property of the material. Since Beers' Law determines a linear relationship between extinction coefficient and absorbance, materials with higher extinction coefficients, such as dyes and pigments, will serve to improve the signal-to-noise ratio. In one embodiment, the percent loading of the spectral marker relative to the total percent solids by weight in the charge transport layer is 5% or less. In another embodiment, the percent loading is 1% or less. In yet embodiment, the percent loading is 0.5% or less.

The absorbance of the spectral absorber should not significantly overlap with the emission wavelength of the image writing light source. In one embodiment, the percent of spectral marker absorbance at the emission wavelength of the image writing source, compared to the absorption maximum of the spectral marker, should be about 0% to about 10%. In another embodiment, the percent of spectral marker absorbance at the emission wavelength of the image writing source, compared to the absorption maximum of the spectral marker, should be about 0% to about 5%.

It is believed that the absorption maximum of the marker can be any wavelength in the visible to near IR range, except those that significantly overlap with the emission wavelength of the image writing light source. In other words, the absorption maximum of the spectral marker should be outside (i.e., above and below) of the emission wavelength maximum of the image writing light source by a predetermined amount. In one embodiment, the solvent or pigment-type spectral marker possesses an absorption maximum at least about 70 nm above or below the emission wavelength of the image writing light source. The visible portion of the electromagnetic spectrum ranges from 400 nm to 750 nm, and the near infrared portion of the electromagnetic spectrum ranges from 750 nm to 2500 nm. Solid state lasers with emissions in the near infrared are currently preferred due to their low cost, fast switching times, and stability of output. In another embodiment, the image writing light source is a 780 nm laser diode, and the absorption maximum of the spectral marker comprises the ranges of about 850 nm to about 2500 nm, and about 400 nm to about 710 nm, which are about +70 nm outside of the 780 nm emission wavelength maximum of the laser diode.

Solvent Type Spectral Markers

Many dyes are soluble in photoreceptor coating solvents. They are also compatible with components of the charge transport layer, such as thermoplastics and triarylamines. In a non-limiting example, the spectral marker is composed of a solvent dye. These materials are soluble in common organic solvents, insoluble in water, and possess high ionization potentials.

The following list contains examples of solvent dyes which are expected to be appropriate for use in the present invention, given a 780 nm image writing light source: xanthene dyes such as fluorescein, acrinine dyes such as acridine orange, anthraquinone dyes such as Solvent Violet 13 and Solvent Green 3, triarylmethane dyes such as phenolphthalein, azo dyes such as Sudan I and Oil Red O, azin dyes such as phenazine, eurhodin dyes such as neutral red, indophenol dyes such as dichlorphenolindophenol, oxazin dyes such as Nile Red, fluorone dyes such as fluorescein and erythrosine, the metal complex 1,2-bis(3,4-dimethoxyphenyl)-1,2-ethenedithiol nickel, a 1:1 mixture (by weight) of 1,2-bis(4-methoxyphenyl)-1,2-ethenedithiol palladium (CAS#58050-84-3) and tetrakis(4-methoxyphenyl)thiophene (CAS#66178-18-5). In general, Solvent Yellow, Solvent Orange, Solvent Green, Solvent Violet, and Solvent Blue compounds are suitable candidates for spectral marking, given a 780 nm light source.

There are many examples of solvent dyes which are expected to be useful as spectral markers, given an image writing light source emitting in the blue portion of the electromagnetic spectrum, between about 431 nm to about 500 nm. Categorizing solvent dyes possessing maximum absorptions greater than about 500 nm serves to include image writing light sources emitting at 431 nm. For example, a dye with a maximum absorbance value of 500 nm would be appropriate for use with a 431 nm light source, but not appropriate for use with a 470 nm light source. The following list contains solvent dyes possessing strong absorptions between about 500 nm and 2500 nm: alkyl and alkoxy substituted phthalocyanines such as silicon 2,9,16,23-tetra-tert-butyl-29H,31H phthalocyanine dihydroxide, and nickel (II) 2,9,16,23-tetraphenoxy-29H,31H-phthalocyanine, porphyrin compounds such as octaethyl porphyrin, anthraquinone compounds such as Quinizarin Green SS, Oil Red ZMG, red azo compounds such as Oil Red G and Sudan Red G, triarylmethane dyes such as phenolphthalein, azin dyes such as phenazine, eurhodin dyes such as neutral red, indophenol dyes such as dichlorphenolindophenol, oxazin dyes such as Nile Red, the metal complex 1,2-bis(3,4-dimethoxyphenyl)-1,2-ethenedithiol nickel, a 1:1 mixture (by weight) of 1,2-bis(4-methoxyphenyl)-1,2-ethenedithiol palladium (CAS#58050-84-3) and tetrakis(4-methoxyphenyl) thiophene (CAS#66178-18-5). In general, Solvent Red, Solvent Green, and Solvent Violet, Solvent Brown, Solvent Black compounds are expected to be suitable candidates for spectral marking, given a 431-500 nm light source.

There are many examples of solvent dyes which are expected to be useful as spectral markers, given an image writing light source emitting in the violet portion of the electromagnetic spectrum, between about 400 nm to about 430 nm. Categorizing solvent dyes possessing maximum absorptions greater than about 470 nm serves to include image writing light sources emitting at 400 nm. For example, a dye with a maximum absorbance value of 470 nm would be appropriate for use with a 400 nm light source, but not appropriate for use with a 420 nm light source, which should use a dye having with a maximum absorbance value of 490 nm or 350 nm. The following list contains solvent dyes possessing strong absorptions between about 470 and 2500 nm: alkyl and alkoxy substituted phthalocyanines such as silicon 2,9,16,23-tetra-tert-butyl-29H,31H phthalocyanine dihydroxide, and nickel (II) 2,9,16,23-tetraphenoxy-29H,31H-phthalocyanine, porphyrin compounds such as octaethyl porphyrin, anthraquinone compounds such as Quinizarin Green SS, Oil Red ZMG, orange and red azo compounds such as Oil Red G and Sudan Red G, triarylmethane dyes such as phenolphthalein, azin dyes such as phenazine, eurhodin dyes such as neutral red, indophenol dyes such as dichlorphenolindophenol, oxazin dyes such as Nile Red, the complex 1,2-bis(3,4-dimethoxyphenyl)-1,2-ethenedithiol nickel, a 1:1 mixture (by weight) of 1,2-bis(4-methoxyphenyl)-1,2-ethenedithiol palladium (CAS#58050-84-3) and tetrakis(4-methoxyphenyl)thiophene (CAS#66178-18-5). In general, Solvent Orange, Solvent Red, Solvent Green, and Solvent Violet, Solvent Brown, Solvent Black compounds are expected to be suitable candidates for spectral marking, given a 400-430 nm light source.

Pigment Type Spectral Markers

Pigments are typically not soluble in photoreceptor coating solvents. They are, however, typically dispersible with components comprising the charge transport layer. Pigments can usually be purchased or milled to very small particle sizes that can reach into the submicron range. Small particle sizes and material compatibility favor homogenous distribution of the pigment particles throughout the charge transport layer.

The following list contains examples of pigments which are expected to be appropriate for use in the present invention, given a 780 nm emission wavelength maximum image writing light source: monoazo pigments such as Pigment Yellow 1, 2, 3, 5, 6, 10, 49, 60, 65, 73, 74, 75, 97, 98, 111, 116, 130, 165, 167, Pigment Orange 1 and 6, diarylide pigments such as Pigment Yellow 12, 13, 14, 17, 55, 63, 81, 83, 87, 90, 106, 113, 114, 121, 124, 126, 127, 136, 152, 170, 136, 152, 170, 171, 172, 174, 176, 188, Pigment Orange 15, 16, and 44, bisacetoacetarylide pigments such as Pigment Yellow 16, 155, and 198, disazopyrazolone pigments such as Pigment Orange 13, 14, Pigment Red 37, 38, 41, and 111, β-naphthol pigments such as Pigment Orange 2, 5, Pigment Red 1, 3, 4, and 6, Group 1 naphthol AS pigments such as Pigment Red 2, 3, 7, 8, 9, 10, 11, 12, 13, 14, 15, 16, 17, 18, 21, 22, 23, 38, 95, 112, 114, 119, 136, 148, 170, 187, 223, Pigment Orange 22, 24, Pigment Brown 1, and Pigment Violet 13, group 2 naphthol AS pigments such as Pigment Red 5, 31, 32, 146, 147, 150, 164, 170, 184, 187, 188, 210, 212, 213, 222, 238, 245, 253, 256, 258, 261, 266, 267, 268, 269, Pigment Orange 38, Pigment Violet 25, 44, 50, and Pigment Blue 25, benzimidazolone pigments such as Pigment Yellow 120, 151, 154, 175, 180, 181, 194, Pigment Orange 36, 60, 62, 72, Pigment Red 171, 175, 176, 185, 208, Pigment Violet 32, and Pigment Brown 25, disazo pigments such as Pigment Yellow 93, 94, 95, 128, 166, Pigment Red 144, 166, 214, 220, 221, 242, 248, 262, Pigment Orange 31, Pigment Brown 23, 41, and 42, metallated azo pigments such as Pigment Green 10, and 150, metallated azomethine pigments such as Pigment Yellow 117, 129, 153, 177, 179, 257, 271, Pigment Orange 59, 65, and 68, Isoindoline pigments such as Pigment Yellow 109, 110, 139, 173, 185 Pigment Orange 61, 66, 69, Pigment Red 260, and Pigment Brown 38, perylene pigments such as Pigment Red 123, 149, 178, 179, 190, 224, and Pigment Violet 29, perinone pigments such as Pigment Orange 43, Pigment Red 194, diketopyrrolo-pyrrole (DPP) pigments such as Pigment Orange 71, 73, Pigment Red 254, 255, 264, and 272, thioindigo pigments such as Pigment Red 88 and 181, anthroquinone-azo pigments such as Pigment Red 251, aminoanthraquinone pigments such as Pigment Red 89 and 177, Pigment Yellow 123, 147, 193, and 199, anthrapyrimidine pigments such as Pigment Yellow 108 and Vat Yellow 20, indanthrone pigments such as Pigment Blue 60, flavanthrone pigments such as Pigment Yellow 24, pyranthrone pigments such as Pigment Orange 40, 51, Pigment Red 216, and 226, anthanthrone pigments such as Pigment Red 168. isoviolanthrone pigments such as Pigment Violet 31, quinophthalone pigments such as Pigment Yellow 138, quinacridones such as Pigment Red 122, dichlorobenzidines such as Pigment yellow 12, triarylcarbonium pigments such as Pigment Blue 18, 19, 56, and 61, the croconine 3-(2-Hydroxy-julolidin-4-yl)-5-(1,4-dihydro-2-hydroxy-julolidin-4-ylidene-onium)-1,2-dioxo-cyclopenten-4-olate (CAS #150981-08-1), rhodamines such as Pigment Violet 1, and the squaraines 1-(2-Hydroxy julolidin-4-yl)-3-(1,4-dihydro-2-hydroxy-julolidin-4-ylidene-onium)-2-oxo-cyclobuten-4-olate (CAS #93470-31-6), 1-(1,1,3-Trimethyl-1H-benzo[e]indol-2-ylidene-methyl)-3-(1,1,3-trimethyl-1H-benzo[e]indolium-2-yl-methylene)-cyclobuten-2-one-4-olate (CAS #116477-16-8), 1-(5-Piperidino-thien-2-yl)-3-(2,5-dihydro-5-[piperidin-1-ylidene-onium]-thien-2-ylidene)-2-oxo-cyclobuten-4-olate (CAS #37020-22-5), 1-(4-Dimethylamino-2-hydroxy-phenyl)-3-(4-dimethylimmonium-2-hydroxy-cyclohexa-2,5-dien-1-ylidene)-2-oxo-cyclobuten-4-olate (CAS #63842-83-1), 1-(4-Diethylamino-2-hydroxyphenyl)-3-(4-diethylimmonium-2-hydroxycyclohexa-2,5-dien-1-ylidene)-2-oxo-cyclobuten-4-olate (CAS #68842-66-0), 1-(1,1-Dimethyl-3-butyl-1H-benzo[e]indol-2-ylidenemethyl)-3-(1,1-dimethyl-3-butyl-1H-benzo[e]indolium-2-yl-methylene)-cyclobuten-2-one-4-olate (CAS #125597-36-6).

There are many examples of pigments which are expected to be useful as spectral markers, given an image writing light source emitting in the blue portion of the electromagnetic spectrum, between about 431 nm to about 500 nm. Categorizing pigments possessing maximum absorptions greater than about 500 nm serves to include image writing light sources emitting at 431 nm. For example, a dye with a maximum absorbance value of 500 nm would be appropriate for use with a 431 nm light source, but not appropriate for use with a 470 nm light source. The following list contains pigments possessing strong absorptions between about 500 nm and 2500 nm: phthalocyanine pigments such as titanylphthalocyanine, red disazopyrazolone pigments such as Pigment Red 37, 38, 41, and 111, red β-naphthol pigments such as Pigment Red 1, 3, 4, and 6, red, violet, and brown group 1 naphthol AS pigments such as Pigment Red 2, 3, 7, 8, 9, 10, 11, 12, 13, 14, 15, 16, 17, 18, 21, 22, 23, 38, 95, 112, 114, 119, 136, 148, 170, 187, 223, Pigment Brown 1, and Pigment Violet 13, red, violet and blue group 2 naphthol AS pigments such as Pigment Red 5, 31, 32, 146, 147, 150, 164, 170, 184, 187, 188, 210, 212, 213, 222, 238, 245, 253, 256, 258, 261, 266, 267, 268, 269, and Pigment Blue 25, red, violet, and brown benzimidazolone pigments such as Pigment Red 171, 175, 176, 185, 208, Pigment Violet 32, and Pigment Brown 25, red and brown disazo pigments such as Pigment Red 144, 166, 214, 220, 221, 242, 248, 262, Pigment Brown 23, 41, and 42, red and brown isoindoline pigments such as Pigment Red 260, and Pigment Brown 38, perylene pigments such as Pigment Red 123, 149, 178, 179, 190, 224, and Pigment Violet 29, red perinone pigments such as Pigment Red 194, red diketopyrrolo-pyrrole (DPP) pigments such as Pigment Red 254, 255, 264, and 272, thioindigo pigments such as Pigment Red 88 and 181, anthroquinone-azo pigments such as Pigment Red 251, red aminoanthraquinone pigments such as Pigment Red, indanthrone pigments such as Pigment Blue 60, red pyranthrone pigments such as Pigment Red 216, and 226, anthanthrone pigments such as Pigment Red 168, isoviolanthrone pigments such as Pigment Violet 31, quinacridones such as Pigment Red 122, triarylcarbonium pigments such as Pigment Blue 18, 19, 56, and 61, croconine such as 3-(2-Hydroxy-julolidin-4-yl)-5-(1,4-dihydro-2-hydroxy-julolidin-4-ylidene-onium)-1,2-dioxo-cyclopenten-4-olate (CAS #150981-08-1), rhodamines such as Pigment Violet 1, and squaraines such as 1-(2-Hydroxy julolidin-4-yl)-3-(1,4-dihydro-2-hydroxy-julolidin-4-ylidene-onium)-2-oxo-cyclobuten-4-olate (CAS #93470-31-6), 1-(1,1,3-Trimethyl- 1H-benzo[e]indol-2-ylidene-methyl)-3-(1,1,3-trimethyl-1H-benzo[e]indolium-2-yl-methylene)-cyclobuten-2-one-4-olate (CAS #116477-16-8), 1-(5-Piperidino-thien-2-yl)-3-(2,5-dihydro-5-[piperidin-1-ylidene-onium]-thien-2-ylidene)-2-oxo-cyclobuten-4-olate (CAS #37020-22-5), 1-(4-Dimethylamino-2-hydroxy-phenyl)-3-(4-dimethylimmonium-2-hydroxy-cyclohexa-2,5-dien-1-ylidene)-2-oxo-cyclobuten-4-olate (CAS #63842-83-1), 1-(4-Diethylamino-2-hydroxyphenyl)-3-(4-diethylimmonium-2-hydroxycyclohexa-2,5-dien-1-ylidene)-2-oxo-cyclobuten-4-olate (CAS #68842-66-0), 1-(1,1-Dimethyl-3-butyl-1H-benzo[e]indol-2-ylidenemethyl)-3-(1,1-dimethyl-3-butyl-1H-benzo[e]indolium-2-yl-methylene)-cyclobuten-2-one-4-olate (CAS #125597-36-6).

There are many examples of pigments which are expected to be useful as spectral markers, given an image writing light source emitting in the violet portion of the electromagnetic spectrum, between about 400 nm to about 430 nm. Categorizing pigments possessing maximum absorptions greater than about 470 nm serves to include image writing light sources emitting at 400 nm emission wavelength maximum. For example, a dye with a maximum absorbance value of 470 nm would be appropriate for use with a 400 nm light source, but not appropriate for use with a 420 nm emission wavelength maximum light source. The following list contains pigments possessing strong absorptions between about 470 nm and 2500 nm: orange monoazo pigments such as Pigment Orange 1 and 6, orange diarylide pigments such as Pigment Orange 15, 16, and 44, disazopyrazolone pigments such as Pigment Orange 13, 14, Pigment Red 37, 38, 41, and 111, β-naphthol pigments such as Pigment Orange 2, 5, Pigment Red 1, 3, 4, and 6, group 1 naphthol AS pigments such as Pigment Red 2, 3, 7, 8, 9, 10, 11, 12, 13, 14, 15, 16, 17, 18, 21, 22, 23, 38, 95, 112, 114, 119, 136, 148, 170, 187, 223, Pigment Orange 22, 24, Pigment Brown 1, and Pigment Violet 13, group 2 naphthol AS pigments such as Pigment Red 5, 31, 32, 146, 147, 150, 164, 170, 184, 187, 188, 210, 212, 213, 222, 238, 245, 253, 256, 258, 261, 266, 267, 268, 269, Pigment Orange 38, Pigment Violet 25, 44, 50, and Pigment Blue 25, orange, red, violet, and brown benzimidazolone pigments such as Pigment Orange 36, 60, 62, 72, Pigment Red 171, 175, 176, 185, 208, Pigment Violet 32, and Pigment Brown 25, orange, red, and brown disazo pigments such as Pigment Orange 31, Pigment Brown 23, 41, and 42, metallated azo pigments such as Pigment Green 10, and 150, orange metallated azomethine pigments such as Pigment Orange 59, 65, and 68, Orange, red and brown isoindoline pigments such as Pigment Orange 61, 66, 69, Pigment Red 260, and Pigment Brown 38, perylene pigments such as Pigment Red 123, 149, 178, 179, 190, 224, and Pigment Violet 29, perinone pigments such as Pigment Orange 43, Pigment Red 194, diketopyrrolopyrrole (DPP) pigments such as Pigment Orange 71, 73, Pigment Red 254, 255, 264, and 272, thioindigo pigments such as Pigment Red 88 and 181, anthroquinone-azo pigments such as Pigment Red 251, orange and red aminoanthraquinone pigments such as Pigment Red 89 and 177, indanthrone pigments such as Pigment Blue 60, pyranthrone pigments such as Pigment Orange 40, 51, Pigment Red 216, and 226, anthanthrone pigments such as Pigment Red 168, isoviolanthrone pigments such as Pigment Violet 31, quinacridones such as Pigment Red 122, triarylcarbonium pigments such as Pigment Blue 18, 19, 56, and 61, croconines such as 3-(2-Hydroxy-julolidin-4-yl)-5-(1,4-dihydro-2-hydroxy-julolidin-4-ylidene-onium)-1,2-dioxo-cyclopenten-4-olate (CAS #150981-08-1), rhodamines such as Pigment Violet 1, and aquaraines such as 1-(2-Hydroxy julolidin-4-yl)-3-(1,4-dihydro-2-hydroxy-julolidin-4-ylidene-onium)-2-oxo-cyclobuten-4-olate (CAS #93470-31-6), 1-(1,1,3-Trimethyl-1H-benzo[e]indol-2-ylidene-methyl)-3-(1,1,3-trimethyl-1H-benzo[e]indolium-2-yl-methylene)-cyclobuten-2-one-4-olate (CAS #116477-16-8), 1-(5-Piperidino-thien-2-yl)-3-(2,5-dihydro-5-[piperidin-1-ylidene-onium]-thien-2-ylidene)-2-oxo-cyclobuten-4-olate (CAS #37020-22-5), 1-(4-Dimethylamino-2-hydroxy-phenyl)-3-(4-dimethylimmonium-2-hydroxy-cyclohexa-2,5-dien-1-ylidene)-2-oxo-cyclobuten-4-olate (CAS #63842-83-1), 1-(4-Diethylamino-2-hydroxyphenyl)-3-(4-diethylimmonium-2-hydroxycyclohexa-2,5-dien-1-ylidene)-2-oxo-cyclobuten-4-olate (CAS #68842-66-0), 1-(1,1-Dimethyl-3-butyl-1H-benzo[e]indol-2-ylidenemethyl)-3-(1,1-dimethyl-3-butyl-1H-benzo[e]indolium-2-yl-methylene)-cyclobuten-2-one-4-olate (CAS #125597-36-6).

The spectral marker should impart only a small, or insignificantly impact on the electrical properties of the photoreceptor. Using spectral marker loadings around 5% or less (by weight, relative to the total solids in the formulation) should provide acceptable photoreceptor electrostatics.

The inventors have discovered two infrared absorbing materials that possess the properties detailed above. One of these materials is a 1:1 mixture (by weight) 1,2-bis(4-methoxyphenyl)-1,2-ethenedithiol palladium (CAS#58050-84-3) and tetrakis(4-methoxyphenyl)thiophene (CAS#66178-18-5), available from H.W. Sands as SDA9510. The absorption maximum for this mixture is broad and centered at about 951 nm. Another material, 1,2-bis(3,4-dimethoxyphenyl)-1,2-ethenedithiol nickel (CAS#133721-13-8), available from H.W. Sands as SDA 2635 has a broad absorption max at about 953 nm.

Spectral Marker Detector Properties

One embodiment of the invention comprises a spectral marker detector light source and a spectral marker detector. The spectral marker detector light source is any device capable of providing or a light beam to the surface of the photoreceptor, and possesses an emission wavelength maximum that is a predetermined amount away from the emission wavelength maximum of the image writing light source. The spectral marker detector light source is therefore separate from the image writing light source. The predetermined amount is 70 nm above or below the emission wavelength of the image writing light source. The predetermined amount of ±70 nm matches the absorbance maximum criterion for the spectral marker, relative to the emission of the image writing light source. As described herein, the maximum wavelength of emission of the spectral marker detector light source is preferably close to the maximum absorbance wavelength of the spectral marker. The light source may comprise a plurality of emitters. In one embodiment, the wavelength of emission of the spectral marker detector light source is within the visible to IR range. In another embodiment, the emission wavelength of the detector light source is in the infrared. Linking the emission wavelength of the spectral marker detector light source to the absorbance wavelength maximum of the spectral marker increases light absorbance, and thus creates greater contrast relative to a baseline. In various embodiments, the emission maximum of the spectral marker detector light source may vary from about ±10 nm of the absorption maximum wavelength of the spectral marker, about ±25 nm of the absorption maximum wavelength of the spectral marker, or about ±50 nm of the absorption maximum wavelength of the spectral marker.

In one embodiment, the spectral marker detector light source is an LED or a laser. These light sources emit light in a narrow portion of the electromagnetic spectrum. In another embodiment, the light source comprises a plurality of light sources. In yet another embodiment, the light source is a broadband emitter, such as a tungsten lamp. Broadband emitters produce light covering a broader portion of the electromagnetic spectrum than either an LED or a laser. The spectral range, as well as the width of the light beam, may be refined by use of filters and/or lenses.

The spectral marker detector is any device capable of detecting and measuring reflected light within the wavelength region of the spectral marker detector light emitter. The detector may also include a signal amplifier. The detector may comprise a plurality of detectors. In one embodiment, the detector is a photodiode. In another embodiment, the detector comprises a photodiode array. Other non-limiting examples include: an area scan charge coupled device (CCD), an area scan complementary metal-oxide semiconductor (CMOS) device, a mercury-cadmium-telluride (MCT) detector, a deuterated triglycine sulfate (DTGS) detector, a lead sulfide detector, and a photomultiplier tube.

EXAMPLES

To demonstrate photoreceptor authentication, and photosensitive layer thickness determinations, the following experimental examples are provided. The architecture of the electrostatic tester used for testing is similar to a printer based system. The main components include a charge roll, a high speed electrostatic probe, an erase lamp, and a low-power laser. To ensure correct operation, each of these components is oriented at specified locations and distances. The tester and the test sequence is software controlled. Below is a brief description of the test algorithm:

Negative AC or DC charge is applied to the charge roll shaft. The charge roll and the photoreceptor are in contact and are rotating at a constant speed. The interface between the charge roll and photoreceptor induces a negative charge voltage on the photoreceptor. Charge voltage is specific to a product. Once the desired charge level is reached on the photoreceptor, the laser will turn on, effectively discharging the charge level at the specified location. The electrostatic probe will then measure this discharge level. This step can be construed as the expose-to-develop time. The rotational speed of the photoreceptor usually remains constant. In order to emulate a particular printer speed, the distance between the laser and the electrostatic probe is adjusted. A short distance will emulate a fast printer whereas, a long distance a slow printer. Once the discharge voltage is recorded, the erase lamp will neutralize the remaining amount of voltage on the photoreceptor. Measurements are recorded at various laser powers. Photoreceptor voltage is plotted as a function of laser exposure energy to produce the PID curve discussed previously. Electrostatic measurements typically do not match those found in a printer. The purpose of the testing is to discern relative differences between photoreceptor formulations.

Comparative Example 1

Initial Electrical Evaluation of Photoreceptors with Spectral Markers

Figure 10:
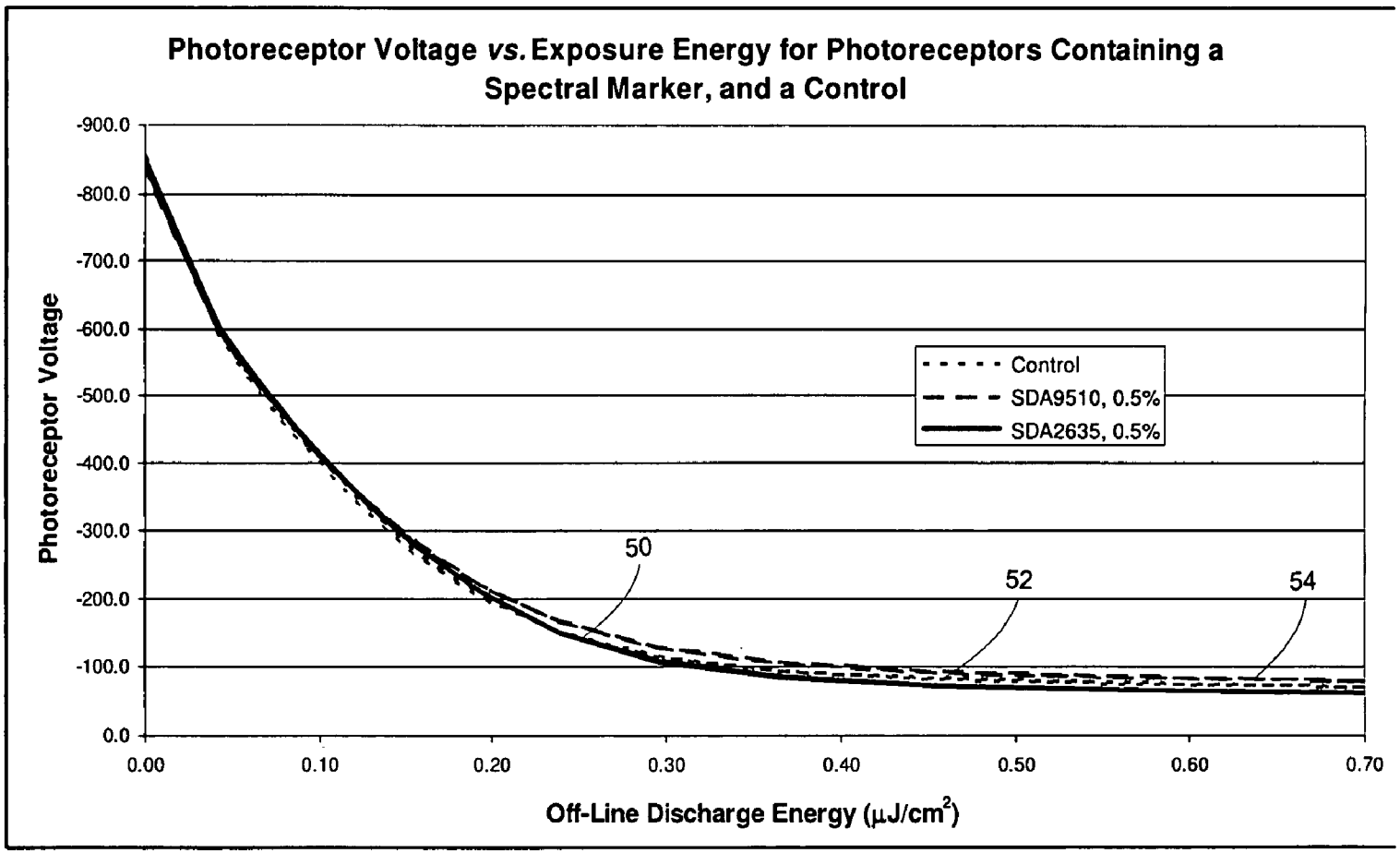
FIG. 10 is a plot of the PID curves for two exemplary photoreceptors containing spectral markers compared to a control photoreceptor.

Two IR absorbing dyes were evaluated with respect to initial electrostatic properties against a control. Negative charging, dual layer organic photoreceptors were prepared according to the following description. The electroconductive substrate used was a cylindrical drum composed of aluminum alloy 6063. The charge generation layer was prepared as described in U.S. patent application Ser. No. 11/535,735 entitled "CONTROL OF CRAZING, CRACKING OR CRYSTALLIZATION OF A CHARGE TRANSPORT LAYER IN A PHOTOCONDUCTOR," and also assigned to the assignee of the present application. The control charge transport layer formulation was prepared by dissolving 38.6 g of N,N'-Bis(3-methylphenyl)-N,N'-diphenylbenzidine (TPD), 15.8 g of polycarbonate Z-300 (Mitsubishi Gas Chemical Co., Inc.), and 47.2 g of polycarbonate-A (Bayer Co.) in a mixed solvent of tetrahydrofuran and 1,4-dioxane. The charge transport layer was coated on top of the charge generation layer and cured at 100° C. for 1 hour to give a thickness of about 25 μm as determined by an eddy current tester. Coating thickness is controlled by adjusting the coating speed. The IR absorbing dye formulations were prepared by removing 0.5% (by weight, relative to the total solids in the formulation) of polycarbonate-A from the control formulation, and adding the same weight of one of the IR absorbers. Coating and curing were performed as described above. Representative photoreceptors were selected for electrostatic evaluation. Initial electrical properties were evaluated using the described in-house tester. FIG. 10 shows the resulting PID curves 50, 52, and 54. The curves for photoreceptors containing the spectral markers 50 and 54 are very similar to that of the control 52, and are appropriate for use.

Comparative Example 2

Spectroscopic Measurements of Photoreceptors with Spectral Markers

Photoreceptors incorporating 0.5% (by weight, relative to the total solids in the formulation) of a 1:1 mixture (by weight) of 1,2-bis(4-methoxyphenyl)-1,2-ethenedithiol palladium and tetrakis(4-methoxyphenyl)thiophene were prepared as described above. Charge transport layer thicknesses of 10.8, 15.8, 20.1, and 26.2 μm were prepared by changing the coating speed, and measuring the resulting thickness on an in-house eddy current tester.

Spectroscopic measurements were made on a Cary 5E IR-Visible-IR spectrometer. A 1.5 $cm^2$ photoreceptor coupon was cut from the photoreceptors described above, and placed in an integrating sphere. The sample chamber is coated with highly reflective PTFE in order to increase the amount of reflected light that may contact the detector. In one experiment, the incident light angle relative to the direction normal to the sample was 0°, this orientation provides a measure of diffuse reflectance. In another experiment, total reflectance was measured by changing the incident angle to 3° 20 minutes, and measuring the reflected light. The specular component of reflectance was calculated by subtracting diffuse reflectance from total reflectance. Reflectance measurements were recorded relative to a PTFE reference disc at 950 nm. Reflectance measurements were converted to absorbance using the following relationship:

$$\text{Absorbance}=\log(1/\text{reflectance})$$

Figure 11:
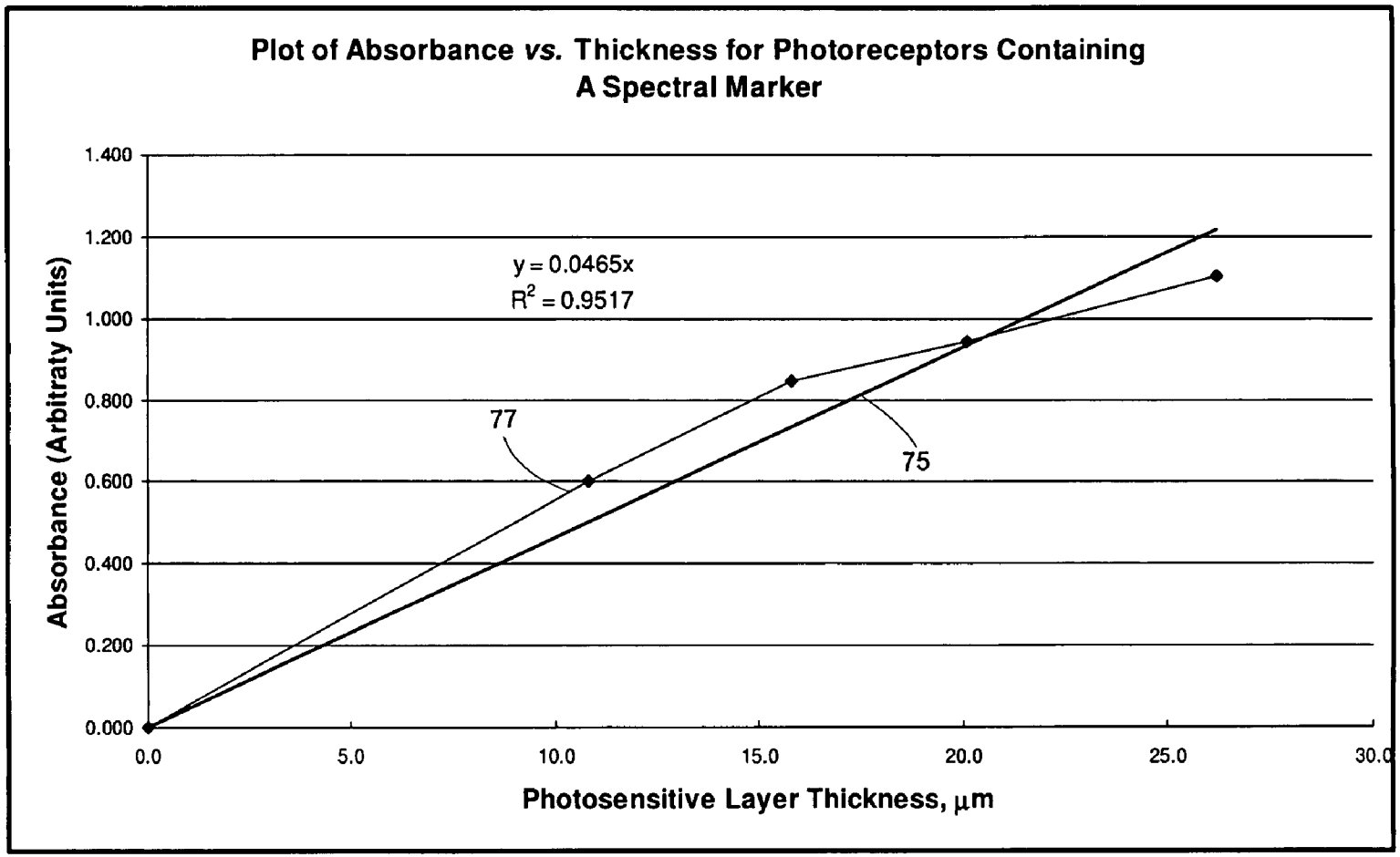
FIG. 11 is a Beers' Law plot of absorbance vs. thickness for photoreceptors containing a spectral marker.

The 950 nm wavelength was selected because it closely matches the absorption max of the spectral marker, as well as the emission max of an LED used in some current toner patch sensors. Absorbance values were referenced to a baseline by dividing each absorbance value by the average absorbance for control photoreceptors coated in the same range. Diffuse absorbance values were plotted against eddy current-determined thickness values. The resulting points were fitted to a straight line using linear regression. The results are shown in FIG. 11. The best fit line 75 is plotted against experimental data line 77. The best fit line 75 has an adjusted R-squared ratio of 0.95, thus showing the applicability of Beers' Law to thickness determinations in this range, i.e., the greater the thickness the higher the absorbance and the lower the reflectance. Diffuse reflectance measurements were used in absorbance calculations since they comprise greater than 96% of total reflectance.

Example 3

Spectroscopic Measurements of Control Photoreceptors

Figure 12:
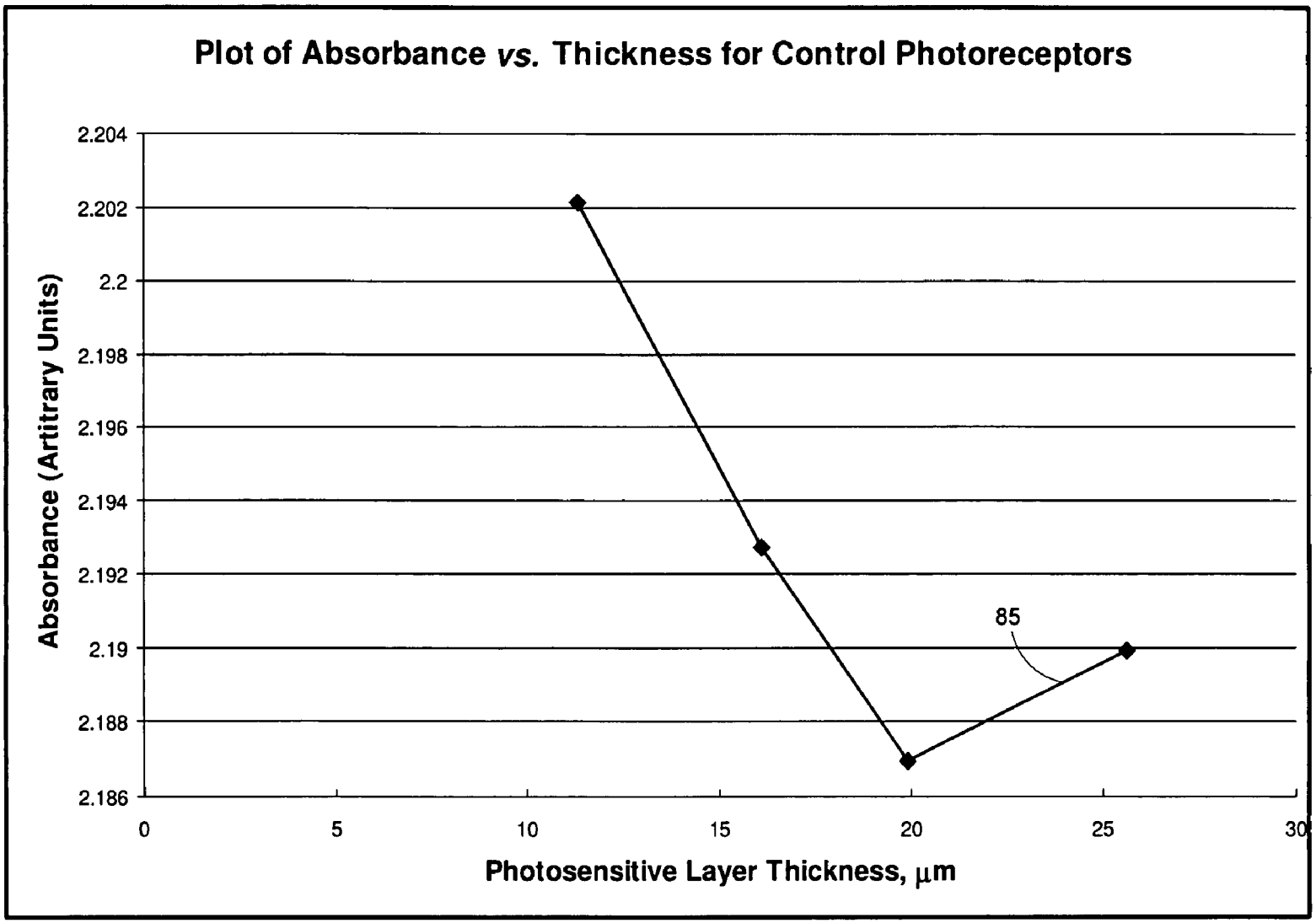
FIG. 12 shows the plot of absorbance vs. thickness for control photoreceptors.

Control photoreceptors with charge transport layer thicknesses of 11.3, 16.1, 19.9, 25.6 μm were prepared as described above. A plot of absorbance as a function of measured thickness was also prepared as described above. The results are shown in FIG. 12. The absorbance vs. thickness plot 85 fails to provide a straight line. The detector lacks the sensitivity to discern thickness differences given a range of only 0.15 absorbance units.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention. It is intended that the scope of the invention be defined by the claims appended hereto.

What is claimed is:

1. A photoreceptor in an electrophotographic imaging system having an image writing light source, the photoreceptor comprising:

an electroconductive substrate;

a charge generation layer deposited over the electroconductive substrate;

a charge transport layer deposited over the charge generation layer, the charge transport layer including a spectral marker having a maximum absorbance at wavelength outside an emission wavelength maximum of the image writing light source by a predetermined amount of ±70 nm, wherein the spectral marker is one of a solvent type and a pigment type at a percent loading of about 0.01% to about 5% by weight relative to the total percent solids in the charge transport layer, and has an insignificant impact on electrical properties of the photoreceptor.

2. The photoreceptor of claim 1, wherein the emission wavelength maximum of the image writing light source is about 780 nm, and the maximum absorbance wavelength of a solvent type spectral marker includes ranges of about 400 nm to less than about 710 nm and greater than about 850 nm to about 2500 nm.

3. The photoreceptor of claim 1, wherein the emission wavelength maximum of the image writing light source is about 431 nm, and the maximum absorbance wavelength of a solvent type spectral marker is in a range of greater than about 500 nm to about 2500 nm.

4. The photoreceptor of claim 1, wherein the emission wavelength maximum of the image writing light source is about 400 nm, and the maximum absorbance wavelength of a solvent type spectral marker is in a range of greater than about 470 nm to about 2500 nm.

5. The photoreceptor of claim 1, wherein the emission wavelength maximum of the image writing light source is about 780 nm and the maximum absorbance wavelength of a pigment type spectral marker includes ranges of about 400 nm to less than about 710 nm and greater than about 850 nm to about 2500 nm.

6. The photoreceptor of claim 1, wherein the emission wavelength maximum of the image writing light source is about 431 nm and the maximum absorbance wavelength of a pigment type spectral marker is in a range of greater than about 500 nm to about 2500 nm.

7. The photoreceptor of claim 1, wherein the emission wavelength maximum of the image writing light source is about 400 nm and the maximum absorbance wavelength of a pigment type spectral marker is in a range of greater than about 470 nm to about 2500 nm.

8. The photoreceptor of claim 1, wherein the electroconductive substrate is an anodized aluminum alloy.

9. The photoreceptor of claim 2, wherein the solvent type spectral marker comprises a metal complex 1,2-bis(3,4-dimethoxyphenyl)-1,2-ethenedithiol nickel.

10. The photoreceptor of claim 2, wherein the solvent type spectral marker comprises a 1:1 mixture (by weight) of 1,2-bis(4-methoxyphenyl)-1,2-ethenedithiol palladium (CAS#58050-84-3) and tetrakis(4-methoxyphenyl) thiophene (CAS#66178-18-5).

11. The photoreceptor of claim 2, wherein the solvent type spectral marker is selected from the group comprising Solvent Yellow dyes, Solvent Orange dyes, Solvent Green dyes, Solvent Violet dyes, and Solvent Blue dyes.

* * * * *